US006092408A

United States Patent [19]

Fabris

[11] Patent Number: 6,092,408

[45] Date of Patent: Jul. 25, 2000

[54] STEEL MILL PROCESSING BY RHOMBIC REVERSAL REDUCTION ROLLING

[76] Inventor: Mario Fabris, 188 N. Service Road, Grimsby, Ontario, Canada, L3M 4E8

[21] Appl. No.: 09/071,933

[22] Filed: May 4, 1998

Related U.S. Application Data

[60] Provisional application No. 60/046,222, May 12, 1997.

[51] Int. Cl.[7] ..... B21B 13/12

[52] U.S. Cl. ..... 72/235; 72/252.5; 72/366.2; 72/467

[58] Field of Search ..... 72/221, 225, 234, 72/235, 276, 366.2, 467, 205, 252.5, 470

[56] References Cited

U.S. PATENT DOCUMENTS

| | | | |
|---|---|---|---|
| 2,038,908 | 4/1936 | Scholl | 72/235 |
| 3,243,983 | 4/1966 | Norlindh et al. | 72/235 |
| 3,618,354 | 11/1971 | Bindernagel et al. | 72/235 |
| 4,211,104 | 7/1980 | Barnabo et al. | 72/467 |
| 4,213,321 | 7/1980 | Properzi | 72/235 |

FOREIGN PATENT DOCUMENTS

| | | | |
|---|---|---|---|
| 213605 | 9/1984 | Germany | 72/235 |
| 58-23501 | 2/1983 | Japan | 72/366.2 |
| 58-32507 | 2/1983 | Japan | 72/235 |
| 62040904 | 2/1987 | Japan | 72/235 |
| 1585032 | 8/1990 | U.S.S.R. | 72/235 |
| 1729635 | 4/1992 | U.S.S.R. | 72/235 |

*Primary Examiner*—Joseph J. Hail, III
*Assistant Examiner*—Ed Tolan
*Attorney, Agent, or Firm*—Edward H Oldham

[57] ABSTRACT

A steel billet is reduced to a bar in a hot steel mill rolling operation by plural reductions successively produced by passage of a workpiece through a series of reducing mill stands. Each mill stand produces a workpiece having a rhombic shaped cross sectional configuration during a reduction passage through each mill stand. The plastic deformation of the workpiece produced by the rollers in each mill stand not only reduces the cross sectional area of the workpiece but also reverses the major and minor axes of the rhombic cross section of the workpiece during passage through each mill stand.

9 Claims, 6 Drawing Sheets

PERCENT REDUCTION
AREA- SQ. MM.

STEEL MILL PROCESSING BY RHOMBIC REVERSAL REDUCTION ROLLING

This application claims the benefit of U.S. Provisional Application Ser. No. 60/046,222 filed May 12, 1997.

This invention relates to a method of reducing a billet by a hot rolling process to a bar by successive passage between serial pairs of rollers in a steel mill. The process is really a continuous hot forging process where a red hot billet of substantially square cross sections emerges from a furnace or soaking pit and is reduced to a bar whose cross section is only a fraction of the cross section of the original billet.

BACKGROUND OF INVENTION

Conventionally, square cross section billets from a furnace are forged into much smaller cross section round workpieces by passage through a series of mill roll stands.

Typically the workpiece (the original square billet) emerges from the first reduction stand with a rectangular section and emerges from the second roll stand with a square section of reduced section area. Following this, sequential pairs of roll stands shape and reduce the workpiece in section by alternately producing oval and circular cross sections of reduced sectional area. A typical mill may utilize a number of roll stands to obtain the desired reduction in cross sectional area.

The change in cross sectional shape which must occur during a typical rolling process as described above, requires substantial energy to produce the change in shape because the transformation from oval (or elliptical) cross section to circular cross section and vice-versa requires that the hot steel undergoing transformation must "flow" substantial distances to produce the change in shape.

To understand some of the dynamics of the metal flow in the prior art method of reduction, the change in shape from an oval to circular cross section is produced by rollers having deep semi-circular or semi ellipsoidal profiles which forces the metal in the workpiece to undergo massive plastic flow during rolling to form the resulting cross section.

Because of the shape of the cavities formed between the mating reducing rolls required to produce sequential ellipsoidal and circular cross sections there is substantial difference in the linear velocity at the largest diameter of roller profile when compared to the velocity of the surface of the roller profile closest to the roller central axis. This means that when the workpiece passes between such rollers, there is a considerably differential in relative velocity between the metal undergoing plastic deformation and elongation and the contacting surface of the rollers producing the change in profile of the workpiece. The differential in the relative motion between the workpiece surface (which undergoing a constant change during passage) is greatest at or near the periphery of the reducing rolls.

It will be understood that there is substantial energy required to produce the plastic flow of the metal undergoing the profile change, and because of the particular shape of the profile of the rollers, there is opportunity for substantial surface erosion of the surface of the roller at places where the relative motion between the workpiece surface and the contacting surface of the roller is greatest, i.e. at or near the periphery of the roller. The "wear" produced in the roll tends to produce an "undercut" in the roller profile just below the exterior surface of the roll such that the width of the semi circular or semi ellipsoidal profile in the roller increases at a point on the roller just below the maximum diameter of the roll. This phenomena tends to produce a lip on the ridge on the outermost portion of the roller profile which in time may become sufficiently proud so as to damage the workpiece as it exits from the roller bight.

It is therefore seen that the traditional classical method of producing the desired reduction in cross sectional area of a billet requires excessive energy which may be subsequently reduced by the judicious selection of the various section shapes formed during a reduction process. Simultaneously, the shape of the profile in the reducing rollers may be changed to a profile which does not produce the drastic plastic flow which leads to prior art surface erosion of the rollers which provide the cross section reduction used in the classical reduction process.

SUMMARY OF THE INVENTION

In view of the above described short comings of the prior art, this invention provides an energy reduction in a method for sequentially reducing the cross sectional area of a workpiece undergoing plastic deformation. At the same time, an increase in the working life of the rollers in the mill stands producing the cross sectional change in the workpiece, will result.

In particular, this invention provides a continuous forging process for causing the repeated re-shaping and reducing of a substantially square cross sectionally shaped metal billet into a bar of circular or other cross sectional shape.

This is accomplished by passage of the hot billet of a substantially square cross section which emerges from a furnace or soaking pit at a temperature of approximately 1050°–1150° C., through a first mill stand which produces a rhombic cross section from the previous square cross section. (The rhombic cross section in this instance follows the classical definition; it is produced to have four equal sides having two opposed acute apices at the ends of its major axis and two opposed obtuse apices at the ends of its minor axis and all four corners at the ends of the axes are slightly rounded. The rounding in this instance is more pronounced for the obtuse apices at the ends of the minor axis.)

The workpiece is passed into a second pair of reducing rollers where the first rhombic cross section is changed such that the major and minor axes of the original rhombic cross section are reversed, or alternated through ninety degrees. The rhombic axial reversal and reduction is continued until the desired reduction has been produced whereupon a final desired shape (i.e. circular) of the workpiece is produced from the original billet. (The last two passes generally produce oval/round cross sections in the bar.)

DESCRIPTION OF THE PREFERRED EMBODIMENT

Turning first to the prior art process as illustrated by FIGS. 1A–1K, FIG. 1A shows a billet 10 having a substantially square cross section with slightly rounded corners and having a cross sectional area of 19,430 sq. mm. This billet is then reduced to workpiece 12 (in FIG. 1B) having a rectangular cross section and then in FIG. 1C a workpiece 14 of square cross section.

Figure 1A:
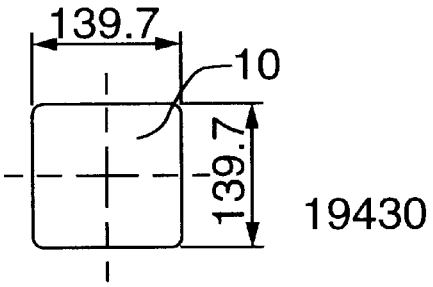
FIG.1A PRIOR ART
FIGS. 1A–1K represent cross sections of the workpiece of the prior art, which shows an illustration of the sequentially assumed cross section of a workpiece undergoing passage through a series of conventional mill roll stands for the purpose of reducing a square billet to that of a cylindrical bar.
Figure 1B:
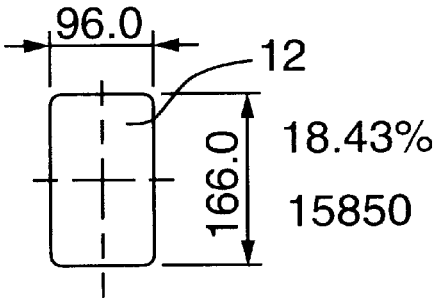
FIG.1B PRIOR ART
Figure 1C:
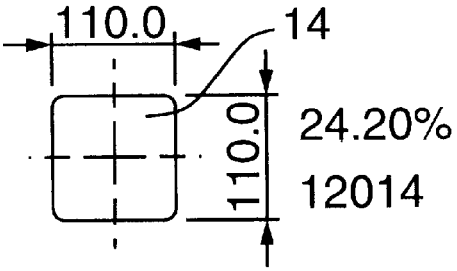
FIG.1C PRIOR ART
Figure 1D:
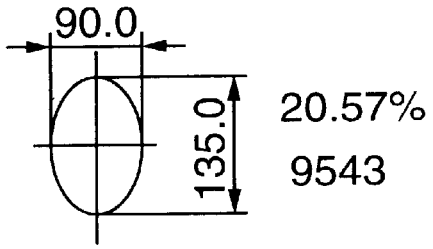
FIG.1D PRIOR ART
Figure 1E:
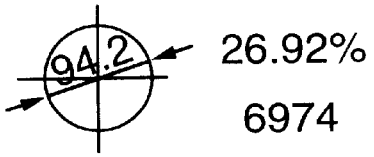
FIG.1E PRIOR ART
Figure 1F:
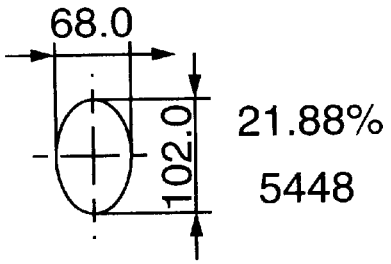
FIG.1F PRIOR ART
Figure 1G:
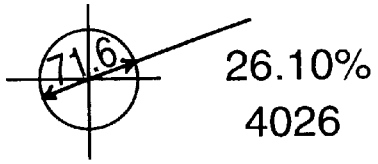
FIG.1G PRIOR ART
Figure 1H:
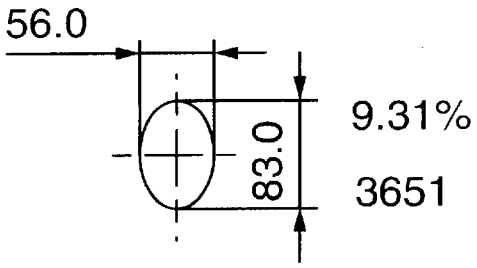
FIG.1H PRIOR ART
Figure 1I:
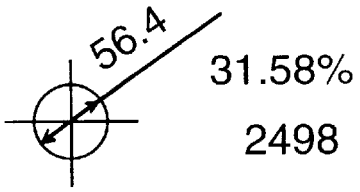
FIG.1I PRIOR ART
Figure 1J:
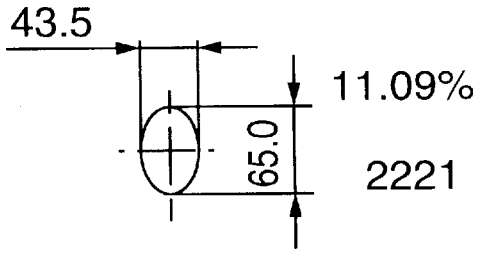
FIG.1J PRIOR ART
Figure 1K:
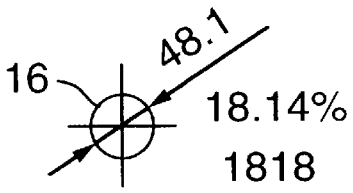
FIG.1K PRIOR ART

From the square cross section of 12,014 sq. mm. the workpiece is sequentially transformed to oval, then round, then oval, etc. cross section until in FIG. 1K the final circular cross section of 1818 sq. mm. is produced.

It will be understood that the process which is involved in producing the change from circular to ellipsoidal and circular cross section involves a "deep draw" profile on the reducing rollers which involves a huge velocity differential on the surface of the reducing rollers producing the required deformation.

In a typical process, the billet 10 is reduced 18.43% in cross section in the first pass; 24.20% in the second pass; 20.57% in the third pass, etc.

The usual percentage reduction in a conventional rolling pass will vary from about 10 to 40 percent.

Figure 2A:
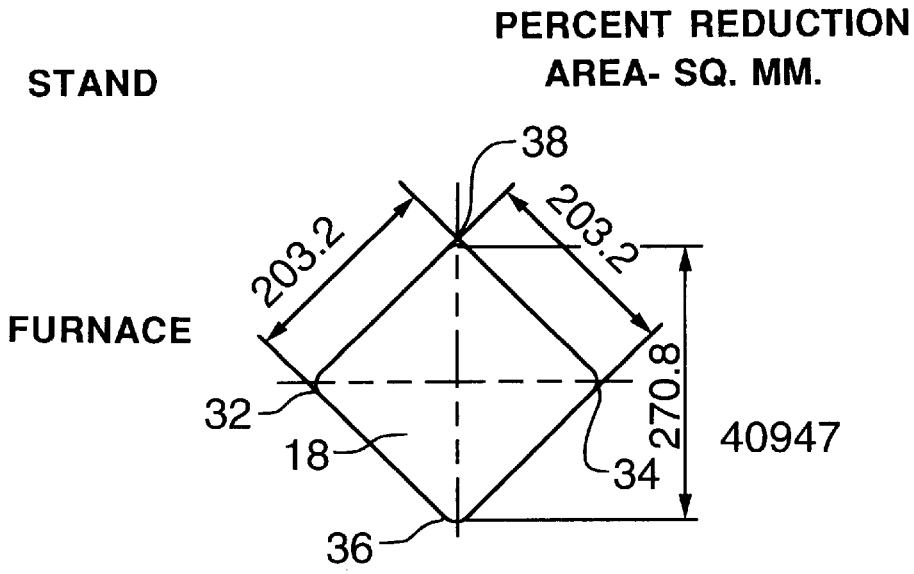
FIGS. 2A–2K are a set of views similar to those of FIG. 1 but showing the continuous reduction in section by rhombic axial reversal as produced during the rolling process of this invention.
Figure 2B:
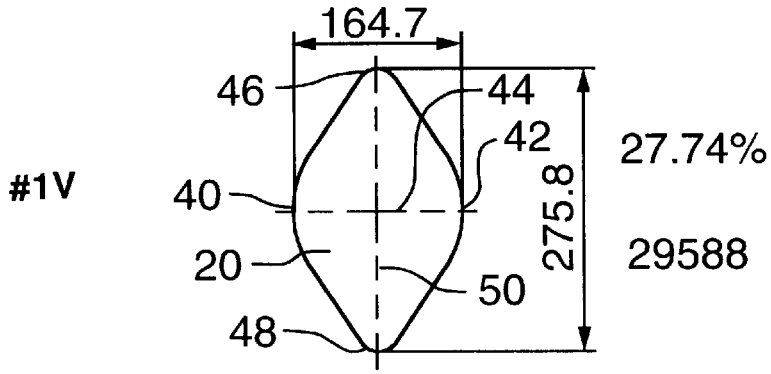
Figure 2C:
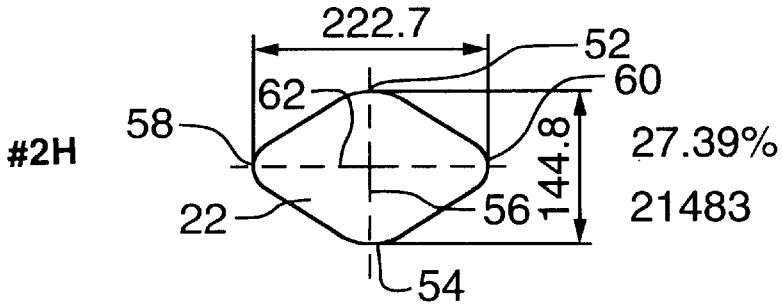
Figure 2D:
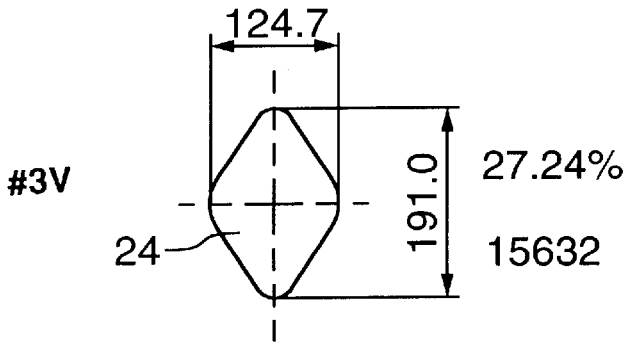
Figure 2E:
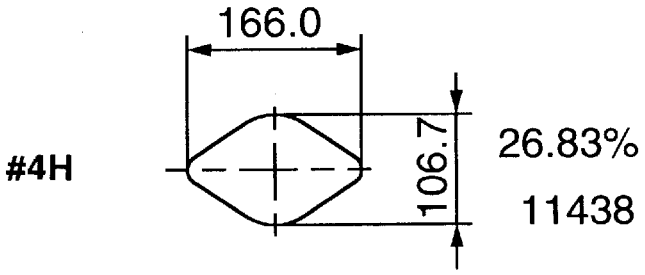
Figure 2F:
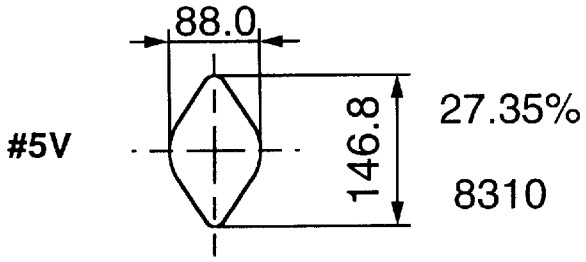
Figure 2G:
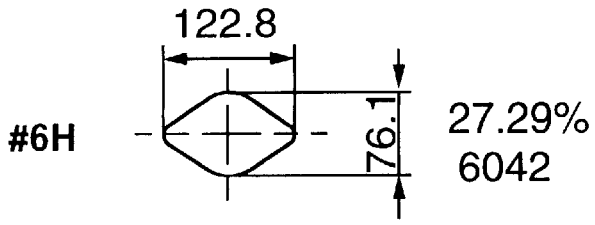
Figure 2H:
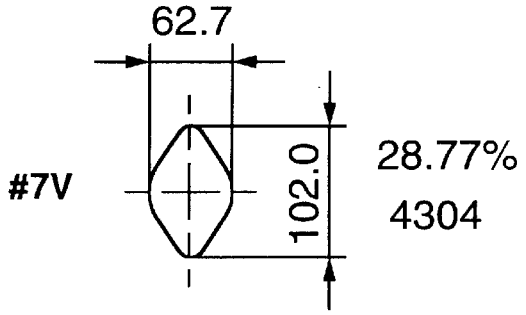
Figure 2I:
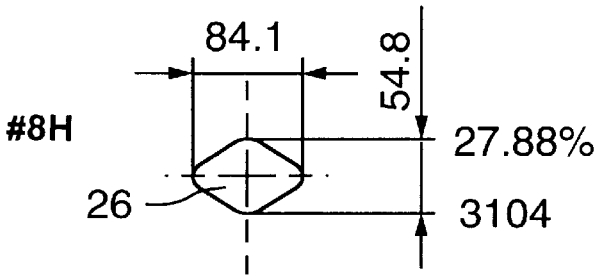
Figure 2J:
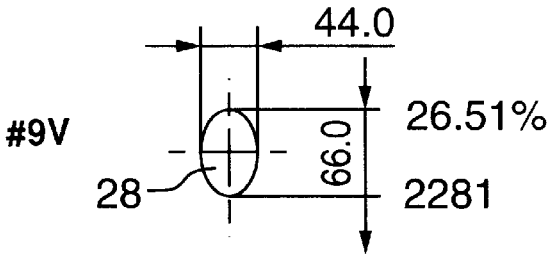
Figure 2K:
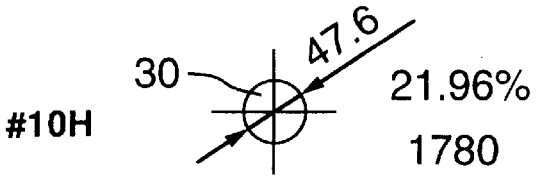

Attention is now directed to FIGS. 2A–2K which illustrate a sequence of cross sectional configuration changes employed by the present invention which is effective in reducing the square billet 16 of FIG. 2A (cross sectional area 40,947 sq. mm.) to a bar 18 of FIG. 2B (having a cross sectional area 1780 sq. mm.) in the same number of passes as the prior art example above.

In applicant's method, the elongate substantially square billet 16 (which has more than twice the cross sectional area of billet 10, for the prior art example illustrated above) is passed through a first roll stand in which the rolls have vertical axes and the shallow V shaped groove in each roll is terminated by peripheral rounded edges to produce the rhombic shaped workpiece 20. The corners 32 and 34 of billet 10 are forced inwardly to produce obtuse apices 40 and 42 of workpiece 20 at the ends of minor axis 44. Similarly acute apices 46 and 48 at the end of major axis 50 are produced by the peripheral curves in the rollers.

In order to force the square billet 18 into the rhombic shape of workpiece 20, the main force is a compressive force exerted on the corners 32 and 34 of workpiece 18. There will be a resultant plastic flow of the material of workpiece 18 to form the rhombic shape. The production of the rhombic shape from the square billet requires less energy for its production than the comparable prior art method of producing a substantially rectangular shape. As a result, the process in accordance with the invention achieves the initial rhombic shape with a reduction of 28% in cross section whereas the prior art reduction at this first step amounts to only 18%.

Returning to the illustration of FIG. 2, the workpiece 20 thence passes through a roll stand where the axis of the rollers are now horizontal (or oriented at 90° to the roller axes of the first stand) so that the rollers now exert compressive pressure on apices 46 and 48 of workpiece 20 to produce a workpiece 22 of rhombic shape having acute apices 46 and 48 of workpiece 20 replaced by obtuse apices 52 and 54 at the ends of minor axis 56. Acute apices 58 and 60 are produced at the ends of the major axis 62 or workpiece 22. The rounded corners of acute apices 58 and 60 are produced by peripheral curves in the rollers producing the rhombic shape.

The shape of the workpiece 22 is essentially the same as the shape of workpiece 20 but with a reduced cross sectional area and the major and minor axes are reversed. Reduction in cross sectional area is about 28%.

The workpiece thereafter passes through a series of roll stands in which the major and minor axis of the workpiece are reversed at each succeeding roll stand.

The process continues until the workpiece 26 emerges as a rhombic workpiece which may be transformed into an elliptical cross section at 28 and a circular cross section at 30 if desired. It will be understood of course that the final reduction steps could alternatively produce other final cross sections as required, such as square, rectangular, oval and so on.

It will be evident that applicant's rhombic reversal reducing process involves a cross sectional area reduction at each stage of between about 26–29% (with the exception of the final reduction stage).

The advantage and special features of this process are numerous. Due to the simplicity of the rhombic shape, (when compared to the ellipsoid shape) the machining of the roll profile is much easier to achieve. No compound radii are present in the roll profile of the rhombic shape to slow down the machining process. Thus, the production of the rhombic profile is much easier to produce on the reducing rolls than the prior art profile. There are no critical draft angles to be produced in the roller profile to prevent the reducing rollers from pinching or catching the sides of the workpiece as it emerges from the reducing rolls.

The forging action of the present invention is ideal, meaning that the area of contact between the workpiece and the rolls is small (i.e. initial contact with the apices of the major axis) and grows as the workpiece spreads to the new rhombic profile. This type of reduction tends to reduce the occurrence of sudden impact loads on the mill stands caused in prior art reduction process where the change in profile is drastic i.e. rectangular to square or circular to elliptical or vice-versa.

As well, overflow conditions are reduced and the diamond or rhombic shape allows the overfill to be more easily monitored.

The geometry of the rhombic cross section of the workpiece is such as to produce a steady consistent separation force in achieving the change in section of the workpiece.

Standard practice for reduction by rolling in the prior art would indicate that reductions of 10–40% are common. This invention seeks to provide a consistent reduction of between 25–30% at each mill stand, which is about mid range of the range of reduction possible.

The roller profile required to produce the rhombic shape of the workpiece is much more easy to produce than the elliptical or circular cross sectional workpiece of the prior art. The shallow angle configuration of the semi rhondic profile is much easier to machine.

Because of the "open" shallow V groove in the reducing rollers, roll breakage is substantially reduced over the deep groove required for prior art sectional shapes. This leads to substantially less roll breakage.

Because of the presence of the rhombic profile which leads to a lower energy plastic flow of the workpiece material during the transformation, the rolls tend to have an increased life over the prior art rolls. No draft angles are present in the rhombic roller profile to eliminate the ever present "drag" in prior art roll profiles.

Finally, the present invention leads to increased productivity with an equal number of roll stands due to the presence of consistently high reduction rates. Conversely, for a given reduction in cross sectional area from billet to the final form, a smaller number of stands is required.

Other advantages not immediately apparent, will result from the production of the rhombic cross section.

One of the advantages lies in the ease with which the workpiece of rhombic cross section may be guided by the guide rollers used to direct the workpiece into the reducing rollers. In this instance, the guide rollers press against four substantially flat surfaces of the moving workpiece, as opposed to the guide rollers which feed the circular or oval cross sectional workpiece into the reducing rollers. One skilled in the art will realize that the rhombic cross section workpiece is much easier to guide (twisting of the workpiece which can occur in guiding a circular shaped workpiece is substantially eliminated).

Another advantage which will be apparent to those skilled in the art, is the ease with which the rhombic profile may be machined into the reducing rollers when compared to the production of the profile of the circle or oval in the reducing rollers required to produce a work product having a circular or oval cross section.

The rhombic reversal rolling process leads to easier flow and spread of the work product as its major and minor axes are reversed in a reduction rolling process.

Because of the maintenance of a consistent shape (i.e. rhombic) all the associated equipment, i.e. guide rolls, reducing rolls, etc., have the same basic shape.

The method of reduction using rhombic reversal avoids the problem of "undercut" of the rollers ever present in rollers used to produce oval and circular cross sectioned workpieces. (If the undercut is allowed to progress sufficiently in the circular and/or oval roller stands, the workpiece may be damaged by "splitting" of the workpiece.)

Wear of the rolls used to provide the rhombic reversal process is substantially reduced over those rolls used to produce the prior art circular or oval cross sectioned workpieces.

Because the rolls used to produce the rhombic shape have shallower depth than rollers used to produce circular or oval cross sections in the workpiece, roller breakage is substantially reduced.

While only one embodiment of this invention has been illustrated in the accompanying drawings and description herein above, it will be evident to those skilled in the art that changes and modifications may be made therein without departing from the essence of the invention as set forth in the appended claims.

I claim:

1. A method of reducing a hot steel billet workpiece into a bar of desired cross section in a progressive operation by producing steps of reduction during passage of said workpiece through a predetermined number of mill stands in a steel mill comprising:

providing each of said predetermined mill stands with a pair of complementary reduction rollers, each having a surface profile previously selected to produce a rhombic cross sectional shape to said workpiece as said workpiece passes therebetween, such that each mill stand produces a predetermined reduction in cross sectional area of said workpiece during passage therebetween.

2. A method as claimed in claim 1 wherein said rhombic cross sectional shape has a major and minor axis oriented in a predetermined direction upon entry to the rolls of a mill stand.

3. A method as claimed in claim 2 wherein each mill stand reduces said workpiece in cross section, but the major and minor axes of said rhombic cross section produced in said workpiece by said rollers are reversed during passage of said workpiece between said reducing rolls.

4. A method as claimed in claim 2 wherein the ratio of major axis to minor axis of the rhombic cross section produced by said rollers is about 1.75.

5. A method of rolling a workpiece, having the initial form of an elongate, substantially square billet, into a bar of a desired smaller cross section, comprising passing the workpiece through a first roll stand from which it emerges with the cross sectional shape of a rhombus with rounded apices, the rhombus having two opposed acute apices and two opposed obtuse apices, and then passing the workpiece sequentially through a series of roll stands which are such that the workpiece enters each roll stand as a rhombus with the acute apices aligned in a first direction, and emerges from each stand as a rhombus of smaller sectional area having the acute apices aligned in a direction substantially 90 degrees from said first direction, and then passing the workpiece through one or more roll stands with the effect of giving the workpiece the said desired smaller cross section.

6. The method claimed in claim 5, in which the reduction of the cross section of the workpiece is substantially the same for each roll stand.

7. The method claimed in claim 5, in which the reduction of the cross section of the workpiece is substantially the same for each roll stand, and lies within the range from about 25% to about 30%.

8. The method claimed in claim 5, in which the acute apices of the rhombus enclose an angle lying between about 60 degrees and about 75 degrees.

9. The method claimed in claim 8, in which the acute apices of the rhombus enclose an angle of substantially 67 degrees.

* * * * *